US009976385B2

(12) United States Patent
Banerjee

(10) Patent No.: US 9,976,385 B2
(45) Date of Patent: May 22, 2018

(54) VELOCITY SWITCH FOR INFLOW CONTROL DEVICES AND METHODS FOR USING SAME

(71) Applicant: BAKER HUGHES INCORPORATED, Houston, TX (US)

(72) Inventor: Sudiptya Banerjee, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 0 days. days.

(21) Appl. No.: 14/740,481

(22) Filed: Jun. 16, 2015

(65) Prior Publication Data

US 2016/0369571 A1 Dec. 22, 2016

(51) Int. Cl.

*E21B 34/08* (2006.01)
*E21B 43/12* (2006.01)
*E21B 43/24* (2006.01)

(52) U.S. Cl.

CPC ..... *E21B 34/08* (2013.01); *E21B 43/2406* (2013.01)

(58) Field of Classification Search

CPC ..... E21B 17/00; E21B 34/08; E21B 43/12; E21B 43/14; E21B 43/38

See application file for complete search history.

(56) References Cited

U.S. PATENT DOCUMENTS 5,803,179 A * 9/1998 Echols ..... E21B 43/084 166/242.1
6,622,794 B2 * 9/2003 Zisk, Jr. ..... E21B 34/066 166/205
7,789,145 B2 * 9/2010 Patel ..... E21B 34/06 166/227
8,356,668 B2 * 1/2013 Dykstra ..... E21B 34/08 137/808
8,403,038 B2 * 3/2013 Russell ..... E21B 43/12 166/205
8,403,061 B2 * 3/2013 Russell ..... E21B 43/12 166/369
8,430,130 B2 * 4/2013 Dykstra ..... G01F 1/32 137/809
8,469,105 B2 * 6/2013 O'Malley ..... E21B 23/004 166/330
8,469,107 B2 * 6/2013 O'Malley ..... E21B 23/004 166/330
8,527,100 B2 * 9/2013 Russell ..... E21B 43/12 166/228

(Continued)

FOREIGN PATENT DOCUMENTS

WO 02075110 A1 9/2002

OTHER PUBLICATIONS

PCT/US2016/036214—International Search Report dated Oct. 18, 2016.

*Primary Examiner* — Matthew R Buck
(74) *Attorney, Agent, or Firm* — Mossman, Kumar & Tyler, PC

(57) ABSTRACT

An apparatus for controlling a flow of a fluid between a flow bore of a wellbore tubular and a wellbore annulus may include an inflow control device having at least one pressure reducing stage. The stage may include a flow passage along which the fluid flows and a throttle receiving the fluid from the flow passage. The throttle may include a first flow area that is cross-sectionally larger than a second flow area and an outlet in direct fluid communication with the second flow area.

16 Claims, 4 Drawing Sheets

(56) References Cited

U.S. PATENT DOCUMENTS

| | | | | |
|---|---|---|---|---|
| 8,950,502 | B2 * | 2/2015 | Dykstra | G01F 1/32 137/809 |
| 9,291,032 | B2 * | 3/2016 | Greci | E21B 43/12 |
| 2009/0095487 | A1 * | 4/2009 | Xu | E21B 43/32 166/373 |
| 2009/0205834 | A1 | 8/2009 | Garcia et al. | |
| 2009/0283262 | A1 * | 11/2009 | Langeslag | E21B 43/10 166/250.15 |
| 2011/0017311 | A1 | 1/2011 | Mathiesen et al. | |
| 2012/0255351 | A1 | 10/2012 | Dykstra et al. | |
| 2013/0213667 | A1 | 8/2013 | Lopez et al. | |
| 2015/0060084 | A1 * | 3/2015 | Moen | E21B 43/12 166/373 |

* cited by examiner

VELOCITY SWITCH FOR INFLOW CONTROL DEVICES AND METHODS FOR USING SAME

CROSS-REFERENCE TO RELATED APPLICATIONS

N/A

BACKGROUND OF THE DISCLOSURE

1. Field of the Disclosure

The disclosure relates generally to systems and methods for selective control of fluid flow into a production string in a wellbore.

2. Description of the Related Art

Hydrocarbons such as oil and gas are recovered from a subterranean formation using a wellbore drilled into the formation. Such wells are typically completed by placing a casing along the wellbore length and perforating the casing adjacent each such production zone to extract the formation fluids (such as hydrocarbons) into the wellbore. These production zones are sometimes separated from each other by installing a packer between the production zones. Fluid from each production zone entering the wellbore is drawn into a tubing that runs to the surface. It is desirable to control drainage along the production zone or zones to reduce undesirable conditions such as an invasive gas cone, water cone, and/or harmful flow patterns.

The present disclosure addresses these and other needs of the prior art.

SUMMARY OF THE DISCLOSURE

In aspects, the present disclosure provides an apparatus for controlling a flow of a fluid between a flow bore of a wellbore tubular and a wellbore annulus. The apparatus may include an inflow control device having at least one pressure reducing stage. The stage may include a flow passage along which the fluid flows and a throttle receiving the fluid from the flow passage. The throttle may include a first flow area; a second flow area at least partially separated from and parallel to the first flow area, wherein the first flow area is cross-sectionally larger than the second flow area; and an outlet in direct fluid communication with the second flow area.

In aspects, the present disclosure provides a method for controlling a flow of a fluid between a flow bore of a wellbore tubular and a wellbore annulus. The method may include positioning an inflow control device having at least one pressure reducing stage in a wellbore; receiving a multi-phase fluid from the wellbore annulus in the inflow control device, the multi-phase fluid having a gas phase and a liquid phase; and recirculating at least a portion of the gas phase in the at least one pressure reducing stage.

In aspects, the present disclosure further provides an apparatus for controlling a flow of a fluid between a flow bore of a wellbore tubular and a wellbore annulus, wherein the fluid is a multi-phase fluid having a gas phase and a liquid phase. The apparatus may include an inflow control device having a plurality of pressure reducing stages, wherein at least one of the plurality of pressure reducing stages includes a velocity switch configured to recirculate a majority of the gas phase in the associated pressure reducing stage.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the several figures of the drawing and wherein.

DETAILED DESCRIPTION

The present disclosure relates to devices and methods for controlling production from a subsurface reservoir. In particular, passive inflow control devices according to the present disclosure may allow oil/water (or liquid phase) to move through with the same baseline pressure drop, but in the case of live steam/gas (or gas phase) or steam flashing, which is paired with significantly higher volumetric rates & velocities, the passive inflow control devices can force recirculation and apply a backpressure on the reservoir, which may prevent additional gas/steam entrance. In the case of steam, such passive inflow control devices may also force recirculation until condensation occurs, preventing steam hammering effects downstream in the production tubing.

Figure 1:
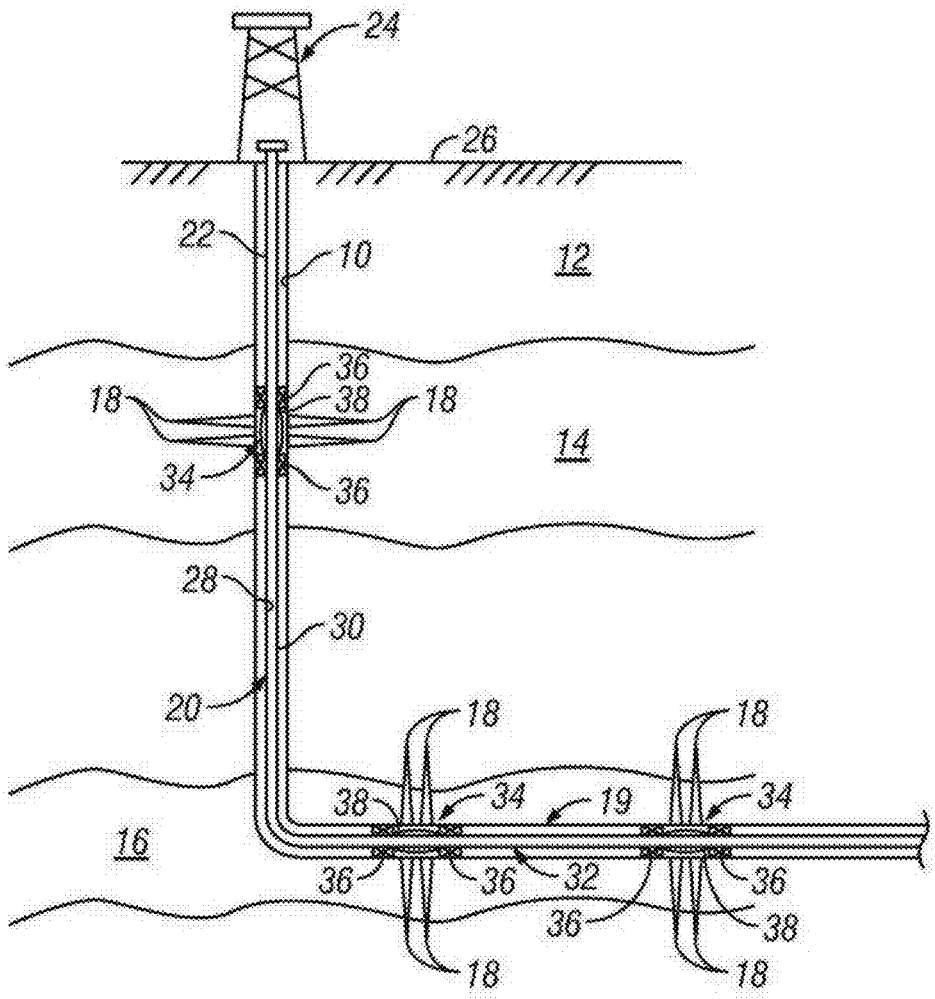
FIG. 1 is a schematic elevation view of an exemplary multi-zonal wellbore and production assembly that may incorporate an inflow control system in accordance with one embodiment of the present disclosure.

Referring initially to FIG. 1, there is shown an exemplary wellbore 10 that has been drilled through the earth 12 and into a pair of formations 14, 16 from which it is desired to produce hydrocarbons. The wellbore 10 is cased by metal casing, as is known in the art, and a number of perforations 18 penetrate and extend into the formations 14, 16 so that production fluids may flow from the formations 14, 16 into the wellbore 10. The wellbore 10 has a deviated or substantially horizontal leg 19. The wellbore 10 has a late-stage production assembly, generally indicated at 20, disposed therein by a tubing string 22 that extends downwardly from a wellhead 24 at the surface 26 of the wellbore 10. The production assembly 20 defines an internal axial flow bore 28 along its length. An annulus 30 is defined between the production assembly 20 and the wellbore casing. The production assembly 20 has a deviated, generally horizontal portion 32 that extends along the deviated leg 19 of the wellbore 10. Production nipples 34 are positioned at selected points along the production assembly 20. Optionally, each production nipple 34 is isolated within the wellbore 10 by a pair of packer devices 36. Each production nipple 34 features a production control device 38 that is used to govern one or more aspects of a flow of one or more fluids into the production assembly 20.

In FIG. 1, the formations 14, 16 may produce gas, such as natural gas, along with liquid hydrocarbons. In some situations, the volume of gas produced may impair the rate at which the liquid hydrocarbons are produced. Thus, in this scenario, it is desirable to control the flow of an inflowing fluid that is naturally occurring (i.e., originating from the formations 14, 16).

Figure 2:
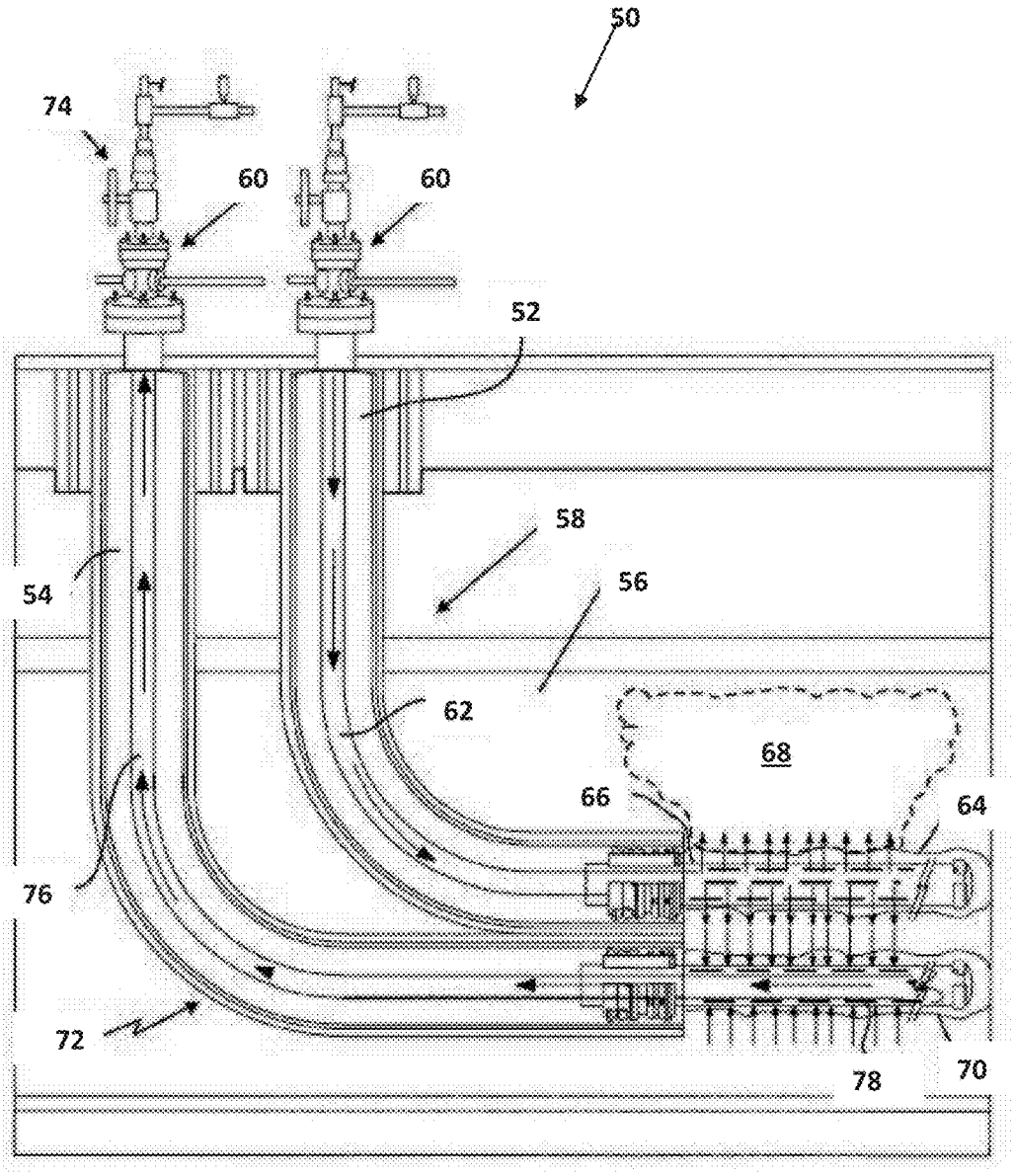
FIG. 2 is a schematic elevation view of a SAGD well that may incorporate an inflow control system in accordance with one embodiment of the present disclosure.

In other situations, the inflowing gas may have been introduced from the surface. Steam Assisted Gravity Drain (SAGD) wells are one type of wells that use steam introduced from the surface during hydrocarbon production. Referring to FIG. 2, an exemplary embodiment of a SAGD system 50 includes a first borehole 52 and a second borehole 54 extending into an earth formation 56. The first borehole 52 includes an injection assembly 58 having an injection valve assembly 60 for introducing steam from a thermal source (not shown), an injection conduit 62 and an injector 64. The injector 64 receives steam from the conduit 62 and emits the steam through a plurality of openings such as slots 66 into a surrounding region 68. Bitumen in region 68 is heated, decreases in viscosity, and flows substantially with gravity into a collector 70.

A production assembly 72 is disposed in second borehole 74, and includes a production valve assembly 74 connected to a production conduit 76. After region 78 is heated, the bitumen flows into the collector 70 via a plurality of openings such as slots 78, and flows through the production conduit 76, into the production valve assembly 74 and to a suitable container or other location (not shown).

In FIG. 2, the steam introduced from the surface may enter the production assembly 72 along with the liquid hydrocarbons. As before, the volume of steam produced may impair the rate at which the liquid hydrocarbons are produced. Thus, in this scenario, it is desirable to control the flow of an inflowing fluid that originates from the surface, or at least not from the formation.

Figure 3:
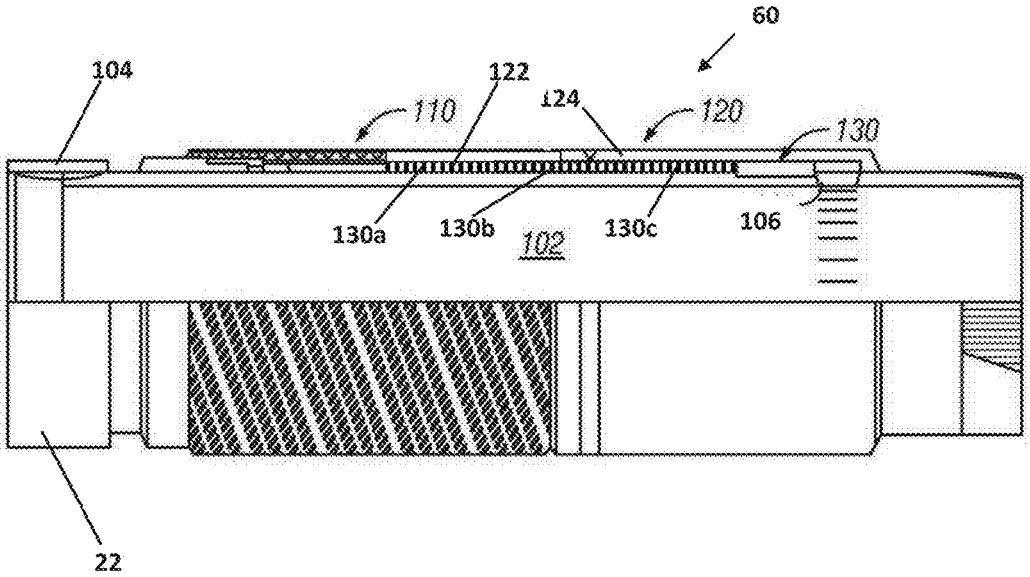
FIG. 3 is a schematic elevation view of an exemplary production assembly which incorporates an inflow control system in accordance with one embodiment of the present disclosure.

Referring now to FIG. 3, there is shown one embodiment of a production control device 100 for controlling the flow of fluids between a reservoir and a flow bore 102 of a tubular 104 along a production string (e.g., tubing string 22 of FIG. 1). In one embodiment, the production control device 100 includes a particulate control device 110 for reducing the amount and size of particulates entrained in the fluids and an inflow control device 120 that controls the overall drainage rate from the formation. The particulate control device 110 can include known devices such as sand screens and associated gravel packs. In embodiments, the inflow control device 120 may use two or more pressure reduction stages 130*a-c* to control an inflow rate and/or the type of fluids entering the flow bore 102 via one or more flow bore openings 106. Generally, each of the stages 130*a-c* may have a toroid shape wherein fluid flows in mostly a circumferential direction within each stage. The stages 130*a-c*, which are stacked along a longitudinal axis, are hydraulically isolated from one another and fluid flow between the stages only under controlled conditions. Illustrative embodiments are described below.

Figure 4:
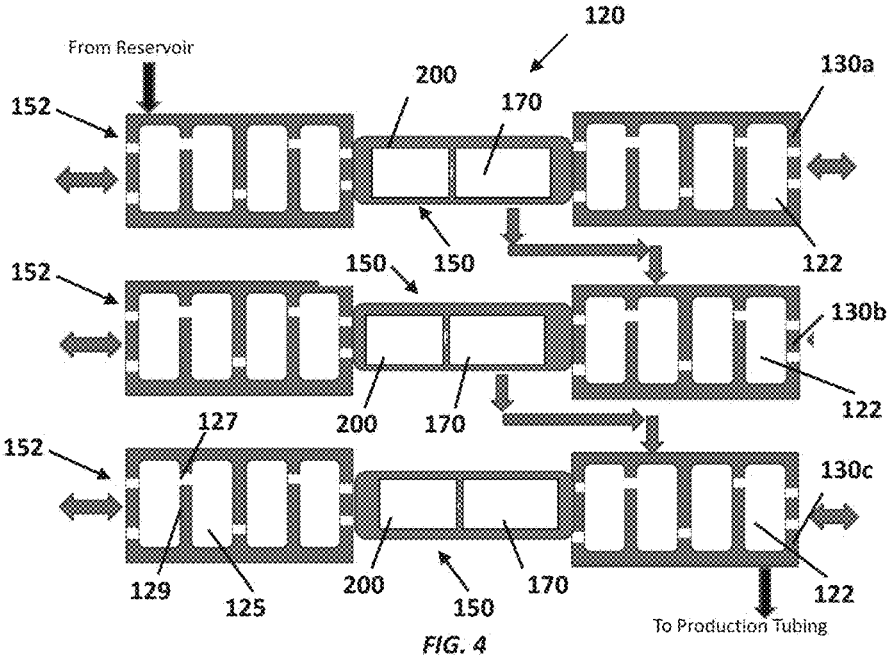
FIG. 4 is a schematic illustration of pressure reduction stages made in accordance with one embodiment of the present disclosure.

Referring now to FIG. 4, there is schematically illustrated one embodiment of a multi-stage inflow control device 120 that controls inflow rates based on fluid velocity. The inflow control device 120 may include a plurality of pressure reduction stages 130*a-c*. Each pressure reduction stage 130*a-c* has a circumferential flow passage 122 that includes passages and channels designed to generate a predetermined pressure drop. Also, each pressure reduction stage 130*a-c* includes a velocity switch 150 that selectively allows fluids to exit a stage 130*a-c*. By "selective," it is meant that the velocity switch 150 selects which fluid to exit and which fluid to recirculate based on the velocity of that fluid. In particular, fluids, or fluid phases, that have a relatively lower flow velocity are preferentially allowed to flow from one stage 130*a-c* to another.

In one embodiment, the flow passages 122 are formed as a circular flow path within a suitable enclosure 124 (FIG. 3). The flow passages 122 may include helical channels, radial channels, circular channels, orifices, chambers, slots, bores, annular spaces and/or hybrid geometries, that are constructed to generate a predetermined pressure differential. By hybrid, it is meant that a give flow passage may incorporate two or more different geometries (e.g., shape, dimensions, etc.). In one non-limiting embodiment, the flow passages 122 may include a series of chambers 125 that are in fluid communication with one another via one or more slots 127 formed in walls 129 separating the chambers. It should be noted that because the flow passages 122 are circular and the stages 130*a-c* are hydraulically isolated from one another, fluid can loop continuously through a flow passage 122. In contrast, in helical flow passages, fluid flows circumferentially but also moves axially and does not recirculate.

The velocity switch 150 allows flow from one stage 130 to the next under certain conditions. Generally speaking, a fluid passes between two stages only if that fluid has a velocity below a predetermined value. Because gas inflow typically has a higher velocity than liquid inflow, the velocity switch 150 favors the flow of liquids between stages and restricts the flow of gases between stages. In one non-limiting embodiment, the velocity switch 150 may include a throttle 170 that controls fluid flow out of a stage 130*a-c* and an ejector 190 that conditions a gas, such as steam, that flows within a stage 130*a-c*. The flow passages 122, the throttle 170, and the steam ejector 200 may be considered to form a circumferential fluid circuit 152 wherein some fluids can recirculate and other fluids can exit.

Figure 5:
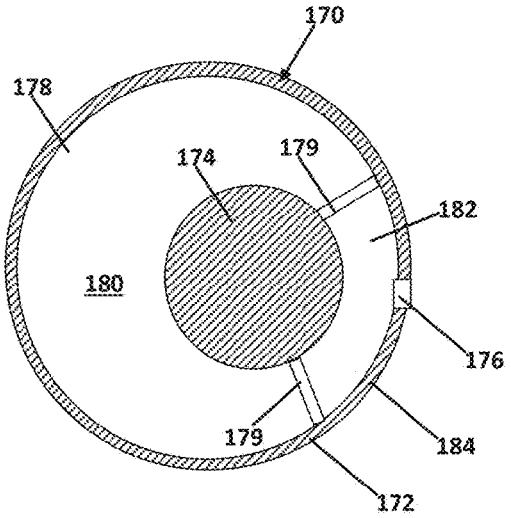
FIG. 5 is a sectional view of a throttle made in accordance with one embodiment of the present disclosure.

Referring now to FIG. 5, there is schematically illustrated one embodiment of a throttle 170 for controlling fluid flow out of the pressure reducing stages 130*a-c* (FIG. 3). The throttle 170 may include an enclosure such as a tube 172 in which a flow dividing body 174 is positioned and an outlet 176. The tube 172 may be a straight or curved length of tubing having a bore 178. While the bore 178 is shown as having a circular cross-section, other geometrical shapes may be used as needed to efficiently flow fluid through the fluid circuit 152 (FIG. 4). The flow dividing body 174 is a structure that is disposed within the bore 178 in a manner that forms two flow paths 180, 182 having different cross-sectional flow areas. The difference in a cross-sectional area of the two flow paths 180, 182 cause at least a majority of the gas phase to flow through the flow area 180. The magnitude of the difference will depend on the encountered flow velocities. The throttle 170 of each stage 130*a-c* may have similarly sized flow paths 180, 182. In other embodiments, each stage 130*a-c* may use a different relative sizing of the flow paths 180, 182 to account of the changes in the amount of gas/steam expected to be encountered at different stages.

In one non-limiting embodiment, the body 174 may be a solid cylinder that is eccentrically positioned in the bore 178. For example, one or more stands 179 may be used to suspend the body 174 such that a central axis of the body 174 is spaced apart from a central axis of the tube 172. This eccentric positioning causes the flow path 180 to have a larger cross-sectional flow area than the flow path 182. The flow paths 180, 182 are parallel; i.e., flow side-by-side and share a same inlet. The outlet 176 may be positioned to directly receive fluid flowing along the flow path 182. For instance, the outlet 176 may be formed within a wall 184 defining the flow path 182 and provides the only fluid communication between two stages, e.g., stages 130*a,b*, which are otherwise hydraulically isolated from one another.

Figure 6:
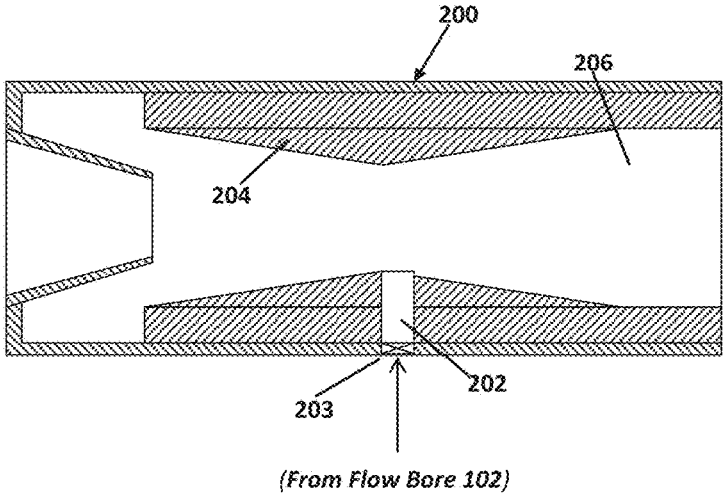
FIG. 6 is a sectional view of an ejector made in accordance with one embodiment of the present disclosure.

Referring now to FIG. 6, there is schematically illustrated one embodiment of an ejector 200 for conditioning a gas phase flowing through the circuit 152 (FIG. 4). When fluid velocity exceeds a predetermined value, the ejector 200 mixes the high-velocity fluid with liquid drawn from a flow bore 102 of a production string. The fluid from the flow bore 102 may be a fluid produced from the formation, or "produced fluid." In one embodiment, the ejector 200 may include an inlet 202, a nozzle section 204, and a mixing chamber 206.

The nozzle section 204 generates a vacuum pressure that varies directly with the velocity of the fluid entering the ejector 200. In one arrangement, the nozzle 204 uses a converging and diverging nozzle set to produce a Venturi effect, which is applied to the inlet 202. The inlet 202 may include a uni-directional valve 203 that opens to allow flow from the flow bore into the ejector 200 if a threshold pressure differential is present. Fluid admitted from the flow bore via the inlet 202 mixes with the high-velocity fluids in the mixing chamber 206. Because the admitted fluid may be cooler and have a lower velocity than the fluid in the ejector 200, the interaction between the admitted liquid and the high-velocity fluid reduces the overall fluid velocity and promotes condensation in the gas phase of the fluid in the ejector 200. Optionally, the ejector 200 may include a diffuser section (not shown) to diffuse the mixture prior to exiting the ejector 200.

Figure 7:
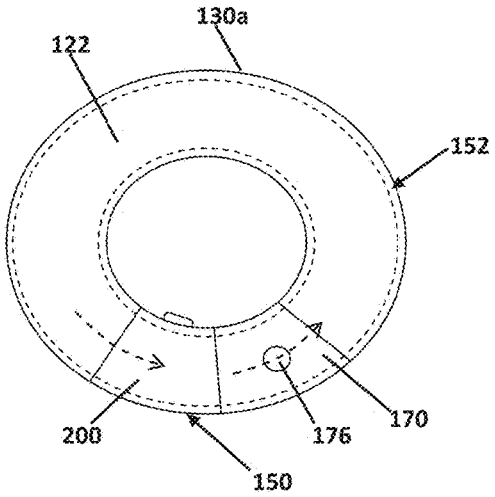
FIG. 7 is a schematic end view of a velocity switch in accordance with one embodiment of the present disclosure.

Referring now to FIG. 7, there is schematically shown one non-limiting arrangement of a velocity switch 150 integrated into a fluid circuit 152 of a pressure reducing stage 130*a-c*. While the velocity switch 150 is shown at the "six o'clock" position (or 180 degree position), the velocity switch may be positioned at any angular location; e.g., "three o'clock" (90 degrees), "nine o'clock" (270 degrees), etc. The ejector 200 may be positioned upstream of the throttle 150. Thus, the fluid flows along the fluid passage 122, into the ejector 200, then the throttle 130, and returns into the fluid passage 122. The flowing fluid has two options of travel: to recirculate through the fluid circuit 152 of the stage 130*a* or to exit to the next stage. To exit to the next stage, however, requires passing through the throttle 170. Fluids at higher velocities will favor the larger flow area 180 (FIG. 5) and will not pass by the outlet 176 to the next stage. Fluids at lower velocities (e.g., water, oil) may divide more equally to the smaller flow area 182 (FIG. 5) with a greater volumetric/mass flow rate moving onto the next pressure reducing stage.

Referring now to FIGS. 1-7, one mode of use may involve an SAGD well wherein injected steam may be produced with liquid hydrocarbons. During such operations, the inflowing fluid may be a multiphase mixture of steam, liquid water, hydrocarbon liquids, and hydrocarbon gases. The gas phase may have a significantly greater flow velocity than the liquid phase. While flowing through the first pressure reducing stage 130*a*, the flow passage 122 reduces the pressure of the gas phase and liquid phase mixture. If the gas phase of the mixture has a sufficiently high velocity upon entering the ejector 200, the resulting vacuum pressure created by the nozzle 204 will cause the valve 203 to lift and draw fluids, which are likely mostly liquids, from the production flow bore 102 into the ejector 200. The drawn fluid will assist in reducing the velocity of the fluid in the ejector 200 and cause liquids to condense from the gas phase.

Next, the fluid mixture flows through the throttle 170, which has two flow areas of differing sizes, flow areas 180, 182. Because the gas phase will have a higher velocity than the liquid phase, the gas phase will strongly favor the larger flow area 180. Due to having a lower velocity, the liquid phase favors neither flow area. However, because the gas phase may consume the majority of the larger flow area 180, the net effect may be that the liquid phase will be forced to disproportionately flow into the smaller flow area 182. Depending on flow velocities, at least a majority (e.g., 51%, 60%, 70%, 80%) of the gas phase may favor the larger flow area 180. Because the outlet 176 is positioned to directly receive fluid from only the smaller flow area 182, the fluid exiting the outlet 176 from the first stage 130*a* to the second stage 130*b* will be primarily a liquid. The remaining fluid, which will be primarily the gas phase, will recirculate in the circuit 152 of the first stage 130*a*. This second trip will further reduce the pressure in the flowing fluid prior to re-entering the ejector 200. Of course, during this process, there is a continuous inflow of fluid from the formation.

The exiting fluids will enter the second stage 130*b*, flow along the flow fluid circuit 152. It should be understood that the exiting fluid may include some of the gas phase; i.e., the throttle 170 does not necessarily prevent all of the gas phase from exiting via the outlet 176. Again, the flow fluid will undergo a pressure reduction and pass through another velocity switch 150. This process continues until the fluid exits via the opening 106 leading to the flow bore 102 of the production string. Thus, the velocity switch of the present disclosure can actively condition a produced gas phase of an inflowing fluid while at the same time favoring the flow of a liquid phase of the inflowing fluid into a production flow bore. It should be understood that the separation between the gas phase and the liquid phase is not perfect and a certain amount of the gas phase can flow between successive pressure reducing stages.

It is also emphasized that the arrangements shown in FIGS. 3-7 are susceptible to numerous variants. For example, while a multi-stage inflow control device has been described, some embodiments may use a single stage inflow control device. Also, the stages of the inflow control device do not have to be identical. For instance, the first stage may have an ejector and a throttle and the later stages may have only throttles. Also, while only one throttle and ejector have been shown for each stage, a stage may incorporate two or more of each device. Still other variants will be apparent to those skilled in the art in view of the present disclosure.

It should be understood that the teachings of the present disclosure may be applied in any situation where multiphase inflowing fluids are present. In the embodiments above, the devices described are used with a hydrocarbon producing well. Also, while an SAGD well with an injector well and a producing well are described, the present teachings may also be used in cyclic injection wells ("huff and puff") wells wherein a single borehole is cyclically injected with steam and then allowed to produce hydrocarbons. In other embodiments, the devices and related methods may be used in geothermal applications, ground water applications, etc. The present disclosure may be particularly useful in wells that encounter multi-phase (e.g., liquid and gas) inflowing fluids. While the wells described above use casing, the above discussion can also equally apply to open hole wells.

For the sake of clarity and brevity, descriptions of most threaded connections between tubular elements, elastomeric seals, such as o-rings, and other well-understood techniques are omitted in the above description. Further, terms such as "slot," "passages," and "channels" are used in their broadest meaning and are not limited to any particular type or configuration. The foregoing description is directed to particular embodiments of the present disclosure for the purpose of illustration and explanation. It will be apparent, however, to one skilled in the art that many modifications and changes to the embodiment set forth above are possible without departing from the scope of the disclosure.

What is claimed is:

1. An apparatus for controlling a flow of a fluid between a flow bore of a wellbore tubular and a wellbore annulus, the apparatus comprising:

an inflow control device having at least one pressure reducing stage, the stage including:

a circular flow passage along which the fluid flows, the circular flow passage encircling the bore of the wellbore tubular;

a throttle receiving the fluid from the flow passage, the throttle including:

a first flow area;

a second flow area at least partially separated from and parallel to the first flow area, wherein the first flow area is cross-sectionally larger than the second flow area; and an outlet in direct fluid communication with the second flow area, the first flow area and the second flow area being arranged to direct the fluid in the first flow area to the outlet via the second flow area, wherein the outlet is in fluid communication with the flow bore of the wellbore tubular.

2. The apparatus of claim 1, wherein the throttle includes:

an enclosure having a bore;

a flow dividing member positioned in the bore to form the first flow area and the second flow area; and a wall at least partially defining the second flow area, wherein the outlet is formed in the wall.

3. The apparatus of claim 2, wherein the enclosure is a tubular member and the flow dividing member is a cylindrical body eccentrically disposed in the bore.

4. The apparatus of claim 1, wherein the fluid is a multi-phase fluid having a gas phase and a liquid phase, wherein a difference in a cross-sectional area of the first and the second flow area is selected to cause a majority of the gas phase to flow through the first flow area.

5. The apparatus of claim 1, further comprising an ejector in fluid communication with the throttle, the ejector including:

an inlet having a unidirectional valve, the valve being configured to admit a produced fluid from the bore of the wellbore tubular into the ejector when subjected to a predetermined pressure differential across the valve; and a nozzle receiving the fluid from the flow passage, the nozzle being configured to generate a vacuum pressure at the inlet.

6. The apparatus of claim 5, wherein the fluid is a multi-phase fluid having a gas phase and a liquid phase, and wherein the predetermined pressure differential is based on a velocity of the gas phase through the nozzle.

7. The apparatus of claim 1, wherein the at least one pressure reducing stage includes a plurality of pressure reducing stages that are hydraulically isolated from one another, and wherein an outlet associated with at least one of the throttles provides fluid communication between at least two of the pressure reducing stages.

8. The apparatus of claim 1, wherein the first flow area is configured to re-circulate a fluid bypassing the second flow area to the flow passage.

9. The apparatus of claim 1, wherein the throttle and the flow passage form a fluid circuit that completely encircles the flow bore of the wellbore tubular.

10. A method for controlling a flow of a fluid between a flow bore of a wellbore tubular and a wellbore annulus, comprising:

positioning an inflow control device having at least one pressure reducing stage in a wellbore;

receiving a multi-phase fluid from the wellbore annulus in the inflow control device, the multi-phase fluid having a gas phase and a liquid phase;

conveying the multi-phase fluid in a circular flow path around the flow bore of the wellbore tubular;

separating the multi-phase fluid using a first flow area and a second flow area formed in the circular flow path, wherein the first flow area is cross-sectionally larger than the second flow area; and recirculating at least a portion of the gas phase from the first flow area in the at least one pressure reducing stage, wherein the recirculated at least a portion of the gas phase exits the at least one pressure reducing stage only after flowing through the second flow area wherein the multiphase fluid exits the inflow control device into the flow bore of the wellbore tubular after being conveyed through the at least one pressure reducing stage.

11. The method of claim 10, wherein the at least a portion of the gas phase is recirculated along the circular flow path formed in the at least one pressure reducing stage.

12. The method of claim 10, further comprising flowing a majority of the gas phase across the first flow area and a majority of the liquid phase across the second flow area, the first and the second flow areas being parallel with one another.

13. The method of claim 12, further comprising directing at least a portion of the liquid phase in the second flow area out of the inflow control device.

14. The method of claim 10, further comprising mixing the gas phase with a produced fluid from the flow bore of the wellbore tubular, the mixing occurring inside the at least one pressure reducing stage.

15. An apparatus for controlling a flow of a fluid between a flow bore of a wellbore tubular and a wellbore annulus, wherein the fluid is a multi-phase fluid having a gas phase and a liquid phase, the apparatus comprising:

an inflow control device having a plurality of pressure reducing stages, each of the plurality of pressure reducing stages having a flow passage encircling the flow bore of the wellbore tubular, wherein at least one of the plurality of pressure reducing stages includes a velocity switch configured to recirculate a majority of the gas phase within the at least one of the plurality of pressure reducing stages while allowing a majority of the liquid phase to exit without being recirculated, wherein the multiphase fluid is configured to exit the inflow control device into the flow bore of the wellbore tubular after being conveyed through the at least one of the plurality of pressure reducing stages, wherein the velocity switch includes at least two differently sized and parallel flow areas.

16. The apparatus of claim 15, wherein the velocity switch further comprising an ejector, the ejector including:

an inlet having a unidirectional valve, the valve being configured to admit a produced fluid from the bore of the wellbore tubular into the ejector when subjected to a predetermined pressure differential across the valve; and a nozzle receiving the fluid from the flow passage, the nozzle being configured to generate a vacuum pressure at the inlet.

* * * * *